US011161216B2

(12) United States Patent
Chung et al.

(10) Patent No.: US 11,161,216 B2
(45) Date of Patent: Nov. 2, 2021

(54) BELT GRINDER

(71) Applicant: INDUSTRIAL TECHNOLOGY RESEARCH INSTITUTE, Hsinchu (TW)

(72) Inventors: Hsiang-Nien Chung, Hsinchu County (TW); Hung-Hsiu Yu, Changhua (TW); Kuo-Feng Hung, Taoyuan (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 539 days.

(21) Appl. No.: 16/191,224

(22) Filed: Nov. 14, 2018

(65) Prior Publication Data

US 2020/0070299 A1 Mar. 5, 2020

Related U.S. Application Data

(60) Provisional application No. 62/723,982, filed on Aug. 28, 2018.

(30) Foreign Application Priority Data

Sep. 19, 2018 (TW) ..... 107133001

(51) Int. Cl.
*B24B 21/06* (2006.01)
*B24B 21/14* (2006.01)
(Continued)

(52) U.S. Cl.
CPC ..... *B24B 21/22* (2013.01); *B24B 21/002* (2013.01); *B24B 21/006* (2013.01);
(Continued)

(58) Field of Classification Search
CPC ... B24B 21/002; B24B 21/006; B24B 21/008; B24B 21/06; B24B 21/08; B24B 21/12; B24B 21/22; B24B 27/0076; B24B 21/16
(Continued)

(56) References Cited

U.S. PATENT DOCUMENTS 1,844,165 A * 2/1932 Kabelec ..... B24B 21/16
451/303
3,538,650 A * 11/1970 Pollak ..... B24B 21/14
451/297
(Continued)

FOREIGN PATENT DOCUMENTS

CN 103419111 A 12/2013
CN 103659536 A 3/2014
(Continued)

OTHER PUBLICATIONS

Edelmann, R., "Non-Linear Control of Robot aided Belt Grinding Manufacturing Processes," Athens Journal of Technology Engineering, vol. 1, issue 1, pp. 1-16 (Mar. 2014).
(Continued)

*Primary Examiner* — Eileen P Morgan
(74) *Attorney, Agent, or Firm* — Maschoff Brennan

(57) ABSTRACT

This disclosure relates to a belt grinder includes frame and first grinding assembly. The first grinding assembly includes transmission roller set, grinding belt and adjusting assembly. The transmission roller set includes driving roller and driven roller. Both the driving roller and the driven roller are rotatably disposed on the frame. The grinding belt is installed over the driving roller and the driven roller. The adjusting assembly includes rotatable component and contact rollers. The rotatable component is rotatably disposed on the frame. Rotation axis of the rotatable component is parallel to rotation axis of the driving roller. The contact rollers are rotatably disposed on the rotatable component.
(Continued)

Contact rollers are different in shape. The rotatable component is rotatable with respect to the frame so as to force one of the contact rollers to contact or to be separated from the grinding belt.

15 Claims, 13 Drawing Sheets

(51) Int. Cl.
*B24B 21/16* (2006.01)
*B24B 21/22* (2006.01)
*B24B 21/00* (2006.01)

(52) U.S. Cl.
CPC ..... *B24B 21/008* (2013.01); *B24B 21/06* (2013.01); *B24B 21/14* (2013.01); *B24B 21/16* (2013.01)

(58) Field of Classification Search
USPC ..... 451/303, 311
See application file for complete search history.

(56) References Cited

U.S. PATENT DOCUMENTS

| | | | | |
|---|---|---|---|---|
| 3,972,152 | A * | 8/1976 | Faure | B24B 21/00 451/303 |
| 4,335,542 | A * | 6/1982 | Howe | B24B 21/008 451/297 |
| 4,617,763 | A * | 10/1986 | Edling | B24B 3/54 451/241 |
| 4,662,116 | A * | 5/1987 | Erani | B24B 25/00 451/296 |
| 6,527,629 | B1 * | 3/2003 | Sandvold | B24B 9/007 451/296 |
| 7,083,505 | B2 | 8/2006 | Carlson, III | |
| 9,193,024 | B2 | 11/2015 | Chen | |
| 9,446,496 | B2 * | 9/2016 | Chen | B24B 21/008 |
| 2015/0044944 | A1 * | 2/2015 | Chen | B24B 27/0023 451/1 |
| 2015/0375357 | A1 * | 12/2015 | Chen | B24B 21/008 451/303 |

FOREIGN PATENT DOCUMENTS

| | | | |
|---|---|---|---|
| CN | 103894907 | A | 7/2014 |
| CN | 205673986 | U | 11/2016 |
| CN | 205968543 | U | 2/2017 |
| CN | 105215817 | B | 4/2017 |
| CN | 107309749 | A | 11/2017 |
| CN | 207027173 | U | 2/2018 |
| DE | 202017100123 | U1 | 11/2017 |
| JP | S5583557 | A | 6/1980 |
| JP | S58109262 | A | 6/1983 |
| JP | S58109263 | A | 6/1983 |
| JP | H0343147 | A | 2/1991 |
| JP | H04176553 | A | 6/1992 |
| JP | 2015-013366 | A | 1/2015 |
| SU | 1227431 | A | 4/1986 |
| TW | M415780 | U | 11/2011 |
| TW | M534657 | U | 1/2017 |

OTHER PUBLICATIONS

Qi, J., et al., "Modeling of the working accuracy for robotic belt grinding system for turbine blades," Advances in Mechanical Engineering, vol. 9, Issue 6, pp. 1-12 (Jun. 2017).
Wei, W., and Chao, Y., "A Path Planning Method for Robotic Belt Surface Grinding," Chinese Journal of Aeronautics, Issue 24, pp. 520-526 (2011).
Zhang, X., et al., "Real-Time Simulation of Robot Controlled Belt Grinding Processes of Sculptured Surfaces," International Journal of Advanced Robotic Systems, vol. 1, Issue 2, pp. 109-114 (2004).
CN Office Action in Application No. 201811188799.6 dated Feb. 3, 2021.
Sheng,Yong-Hua, "Examples of prohibitions in grinding" Jun. 30, 2007.
Taiwan Office Action issued in corresponding application No. 107133001, dated Jan. 19, 2019.

* cited by examiner

BELT GRINDER

CROSS-REFERENCE TO RELATED APPLICATIONS

This non-provisional application claims priority under 35 U.S.C. § 119(a) on Patent Application No(s). 62/723,982 filed in U.S.A on Aug. 28, 2018 and Patent Application No(s). 107133001 filed in Taiwan, R.O.C. on Sep. 19, 2018, the entire contents of which are hereby incorporated by reference.

TECHNICAL FIELD

The present disclosure relates to a belt grinder.

BACKGROUND

The belt grinder is one of the most useful tools to remove material quickly and seamlessly switch to fine finish work. For example, the belt grinder can be used to grind and smooth corners, edges, trenches, and ditches of a semi-finished faucet in order to obtain a glossy faucet.

SUMMARY

According to one aspect of the present disclosure, a belt grinder includes a frame and a first grinding assembly. The first grinding assembly includes a transmission roller set, a grinding belt and an adjusting assembly. The transmission roller set includes a driving roller and at least one driven roller. Both the driving roller and the at least one driven roller are rotatably disposed on the frame. The grinding belt is installed over the driving roller and the at least one driven roller. The adjusting assembly includes a rotatable component and a plurality of contact rollers. The rotatable component is rotatably disposed on the frame. A rotation axis of the rotatable component is parallel to a rotation axis of the driving roller. The plurality of contact rollers is rotatably disposed on the rotatable component. At least two of the plurality of contact rollers are different in shape. The rotatable component is rotatable with respect to the frame so as to force at least one of the plurality of contact rollers to contact or to be separated from the grinding belt.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
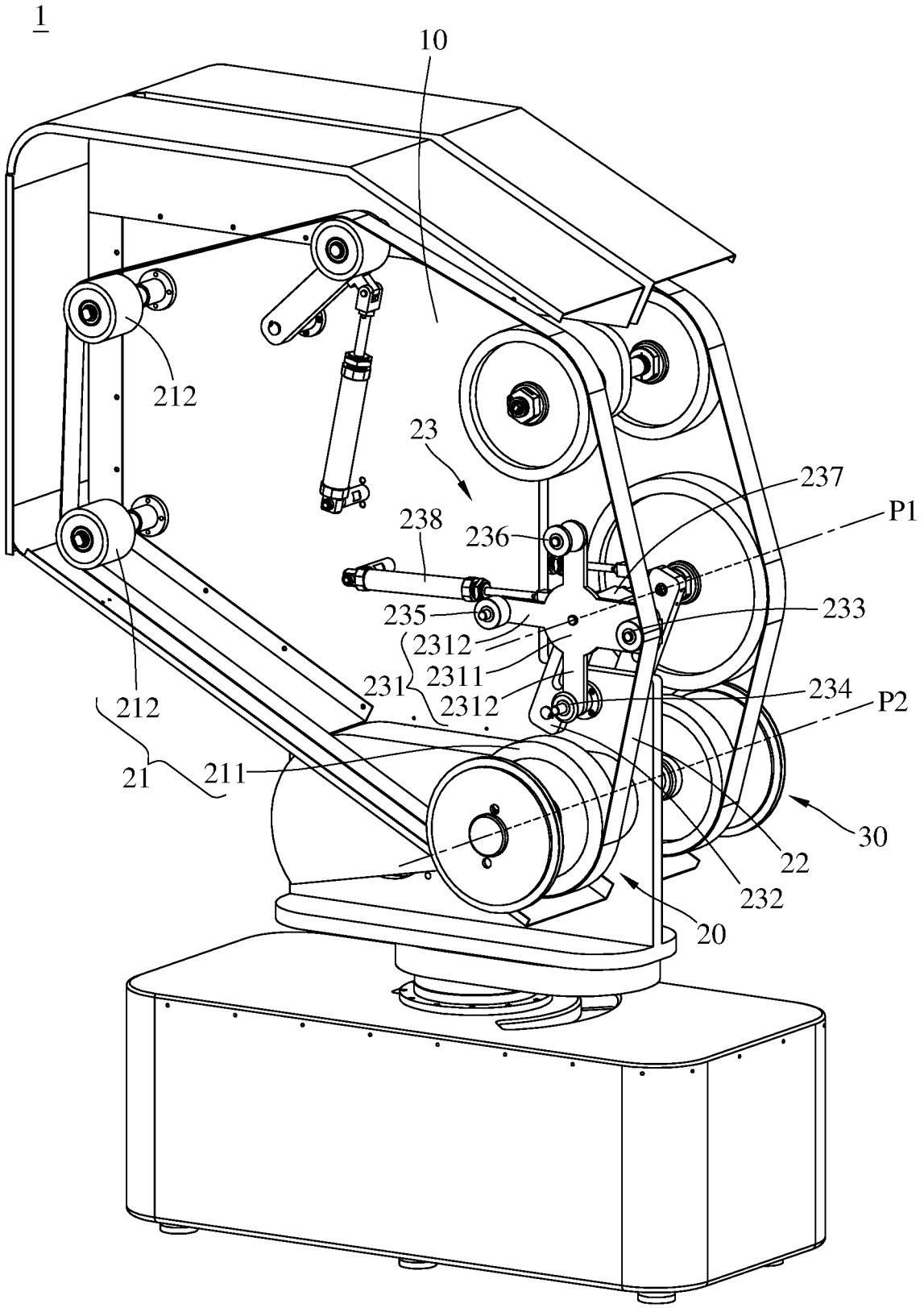
FIG. 1 is a perspective view of a belt grinder according to a first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
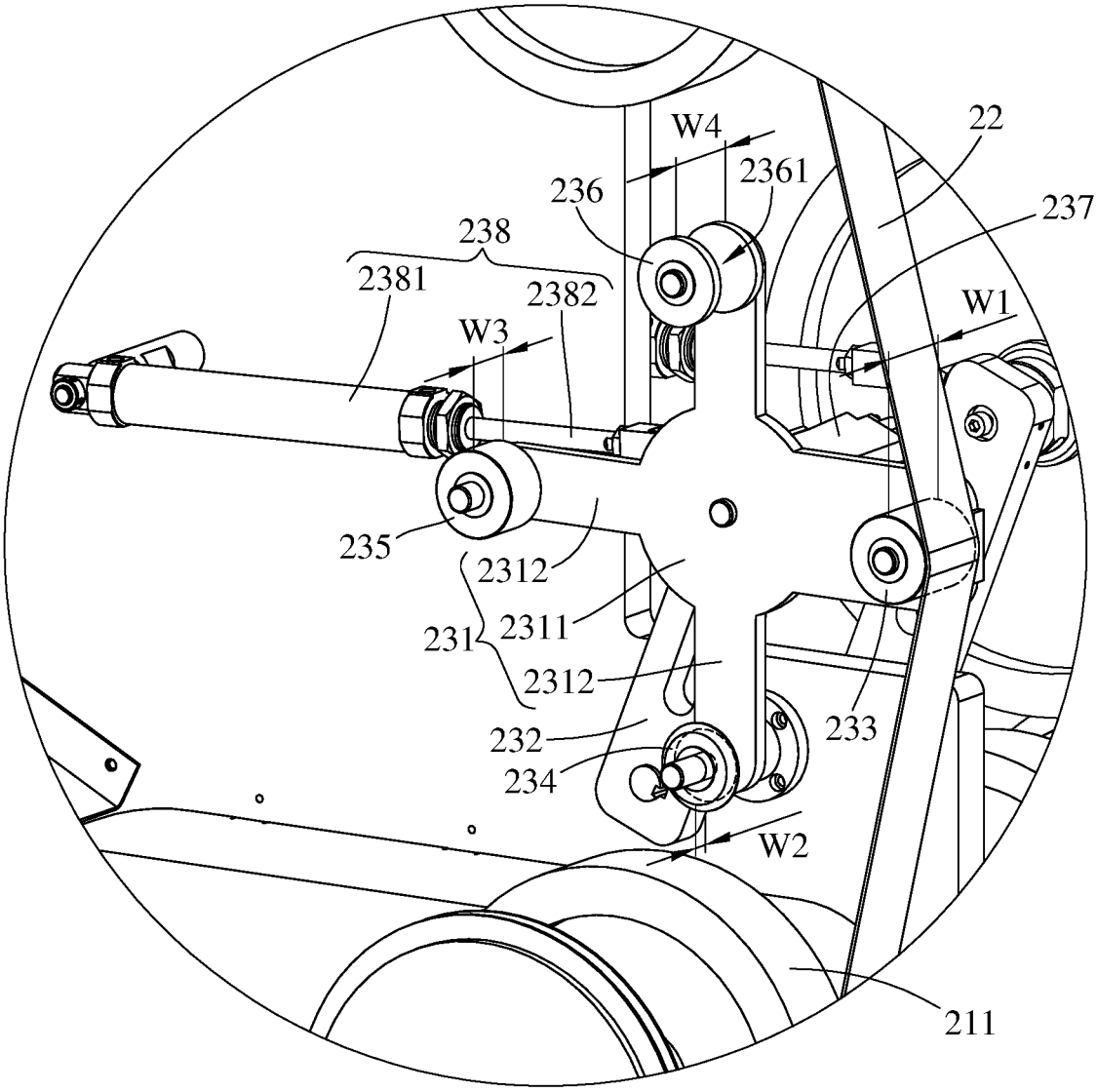
FIG. 2 is a partially enlarged view of the belt grinder in FIG. 1.
Figure 3:
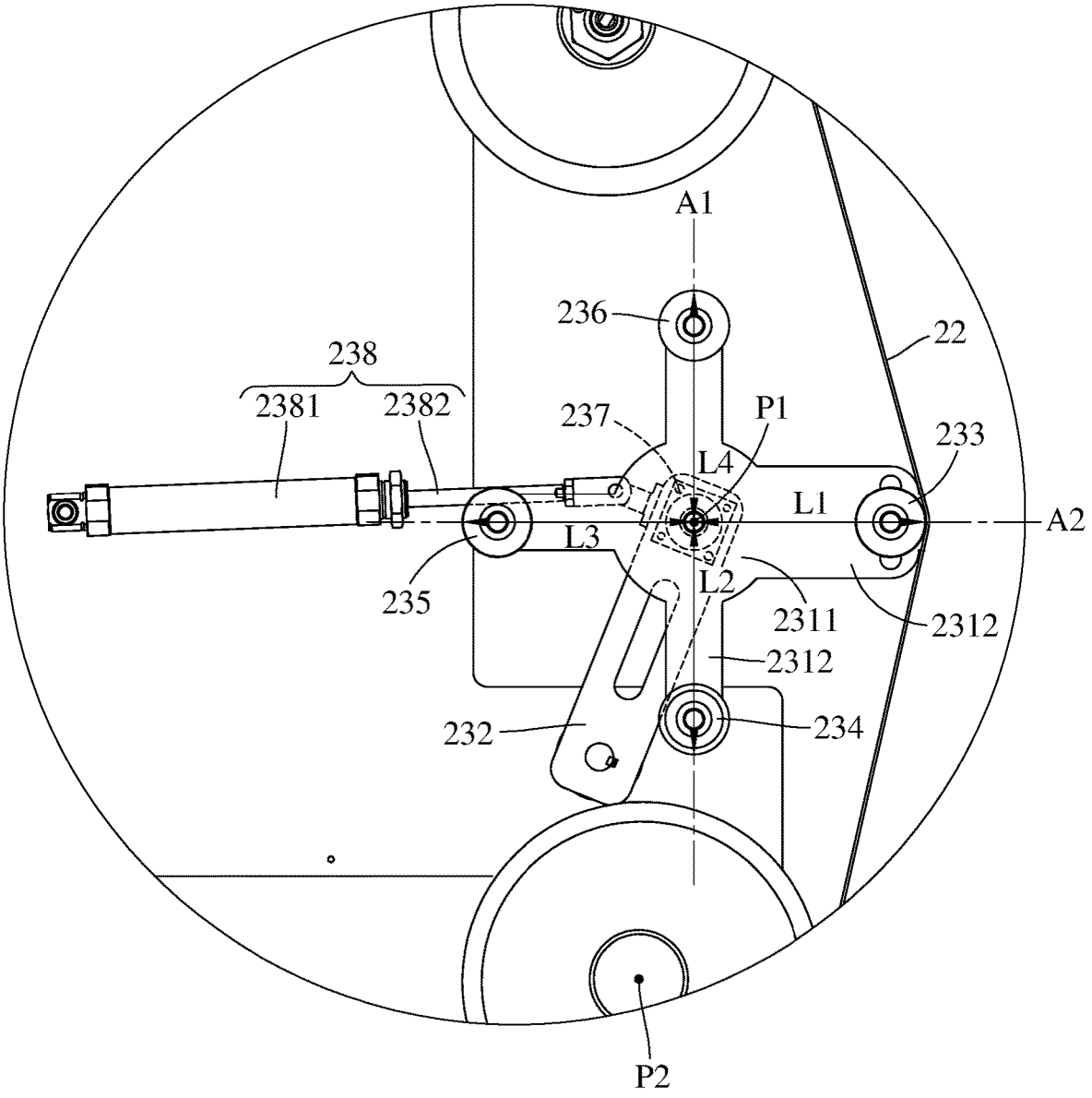
FIG. 3 is a partially enlarged side view of the belt grinder in FIG. 2.

Please refer to FIG. 1 to FIG. 3. FIG. 1 is a perspective view of a belt grinder according to a first embodiment of the present disclosure. FIG. 2 is a partially enlarged view of the belt grinder in FIG. 1. FIG. 3 is a partially enlarged side view of the belt grinder in FIG. 2.

The embodiment provides a belt grinder 1 configured to grind a workpiece. The workpiece may be, for example, a semi-finished faucet. In this embodiment, the belt grinder 1 includes a frame 10, a first grinding assembly 20 and a second grinding assembly 30.

The first grinding assembly 20 includes a transmission roller set 21, a grinding belt 22 and an adjusting assembly 23. The transmission roller set 21 includes a driving roller 211 and a plurality of driven rollers 212. The driving roller 211 and the driven rollers 212 are respectively rotatably disposed on the frame 10. The grinding belt 22 is installed over the driving roller 211 and the driven rollers 212.

The adjusting assembly 23 includes a rotatable component 231, a link 232, four contact rollers 233-236, an electric motor 237 and a fluid driving device 238. The rotatable component 231 includes a central portion 2311 and four extension portions 2312. The link 232 is pivotably disposed on the frame 10. The central portion 2311 is rotatably disposed on a side of the link 232 far away from the frame 10. A rotation axis P1 of the central portion 2311 is parallel to a rotation axis P2 of the driving roller 211. The four extension portions 2312 respectively extend in different directions from the central portion 2311. A reference line A1 passing through ends of two of the extension portions 2312 far away from the central portion 2311 is perpendicular to a reference line A2 passing through ends of the other two of the extension portions 2312 far away from the central portion 2311. On the other words, two of the extension portions 2312 are aligned in a line, and the other two of the extension portions 2312 are aligned in another line that is perpendicular to the previous line. The four contact rollers 233-236 are respectively rotatably disposed at the aforementioned ends of the four extension portions 2312. The contact roller 233 contacts the grinding belt 22.

In more detail, please refer to FIG. 2 and FIG. 3, edges of the four contact rollers 233-236 far away from the central portion 2311 are respectively located at distances of L1, L2, L3 and L4 from the rotation axis P1 of the central portion 2311, and the distances L1-L4 are the same. In addition, the four contact rollers 233-236 are in different shapes. Specifically, a width W1 of the contact roller 233 is substantially equal to a width W4 of the contact roller 236, the widths W1 and W4 are larger than a width W2 of the contact roller 234 and a width W3 of the contact roller 235, the width W3 is larger than the width W2, and the contact roller 236 has a groove 2361.

In this embodiment, the rotatable component 231 includes four extension portions 2312, but the disclosure is not limited thereto. In other embodiments, the rotatable component may include only two or three or more than four extension portions.

The electric motor 237 is, for example, a servomotor. The electric motor 237 is disposed at a joint between the central portion 2311 and the link 232. The electric motor 237 is configured to drive the rotatable component 231 to rotate. Therefore, in this embodiment, the rotatable component 231 is an electrically driven component, but the disclosure is not limited thereto. In other embodiments, the rotatable component may be a manually driven component.

The fluid driving device 238 includes a cylinder tank 2381 and a piston 2382. The cylinder tank 2318 is fixed on the frame 10, and the piston 2382 is movably disposed in the cylinder tank 2381. An end of the piston 2382 is pivotably disposed at the link 232. The purpose of the fluid driving device 238 will be described later.

Figure 4:
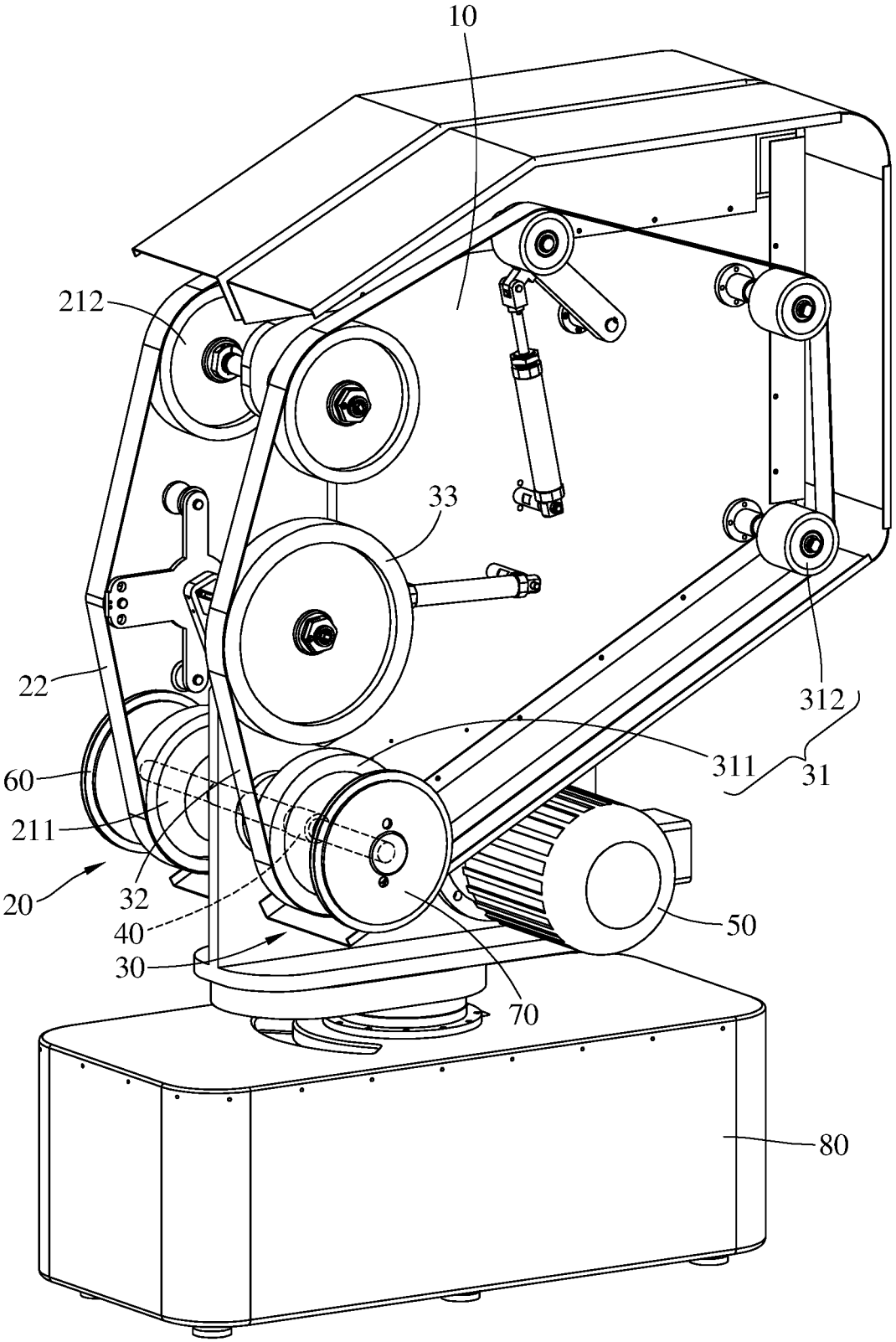
FIG. 4 is another perspective view of the belt grinder in FIG. 1.

Then, please refer to FIG. 4. FIG. 4 is another perspective view of the belt grinder in FIG. 1.

In this embodiment, the second grinding assembly 30 is similar to the first grinding assembly 20. The first grinding assembly 20 and the second grinding assembly 30 are respectively located at two opposite sides of the frame 10. In detail, the second grinding assembly 30 includes a transmission roller set 31, a grinding belt 32 and a contact roller 33. The transmission roller set 31 includes a driving roller 311 and a plurality of driven rollers 312. The driving roller 311 and the driven rollers 312 are respectively rotatably disposed on the frame 10. The grinding belt 32 is installed over the driving roller 311 and the driven rollers 312. The contact roller 33 is disposed on the frame 10 and contacts the grinding belt 32.

In this embodiment, the belt grinder 1 further includes a shaft 40 and a belt driving device 50. The shaft 40 is rotatably disposed at the frame 10. The driving rollers 211 and 311 are fixed on the shaft 40. The belt driving device 50 is, for example, a motor. The belt driving device 50 is disposed on the frame 10 and able to drive the shaft 40 to rotate so as to rotate the driving rollers 211 and 311. In this embodiment, the shaft 40 is driven by the belt driving device 50 via, for example, a belt transmission. During the rotation of the driving roller 211 of the first grinding assembly 20, the grinding belt 22 runs over the driving roller 211, the driven rollers 212 and the contact roller 233 (shown in FIG. 1). Similarly, during the rotation of the driving roller 311 of the second grinding assembly 30, the grinding belt 32 runs over the driving roller 311, the driven rollers 312 and the contact roller 33. At this moment, the running grinding belts 22 and 32 can be used to grind the material of a workpiece.

As shown in FIG. 3 and FIG. 4, a diameter of the contact roller 233 is smaller than a diameter of the contact roller 33. In comparison, the contact roller 233 is more suitable to drive the grinding belt 22 to grind a small curvature surface of a workpiece, and the contact roller 33 is more suitable to drive the grinding belt 32 to grind a large curvature surface of a workpiece.

In this embodiment, the belt grinder 1 further includes two grinding rollers 60 and 70 respectively fixed at two opposite ends of the shaft 40. The driving rollers 211 and 311 are located between the grinding rollers 60 and 70. When the shaft 40 is rotated, the shaft 40 is able to drive the driving rollers 211 and 311 and the grinding rollers 60 and 70 to rotate at the same time. As such, the grinding rollers 60 and 70 are also able to be used to grind a workpiece.

In this embodiment, the belt grinder 1 further includes a platform 80. The frame 10 is disposed on the platform 80, and the platform 80 is configured to rotate the frame 10. In addition, the belt grinder 1 can cooperate with a mechanical arm (not shown in the figures) that can carry and rotate a workpiece in six axes, allowing the belt grinder 1 to grind the surfaces of the workpiece as many as possible.

Figure 5:
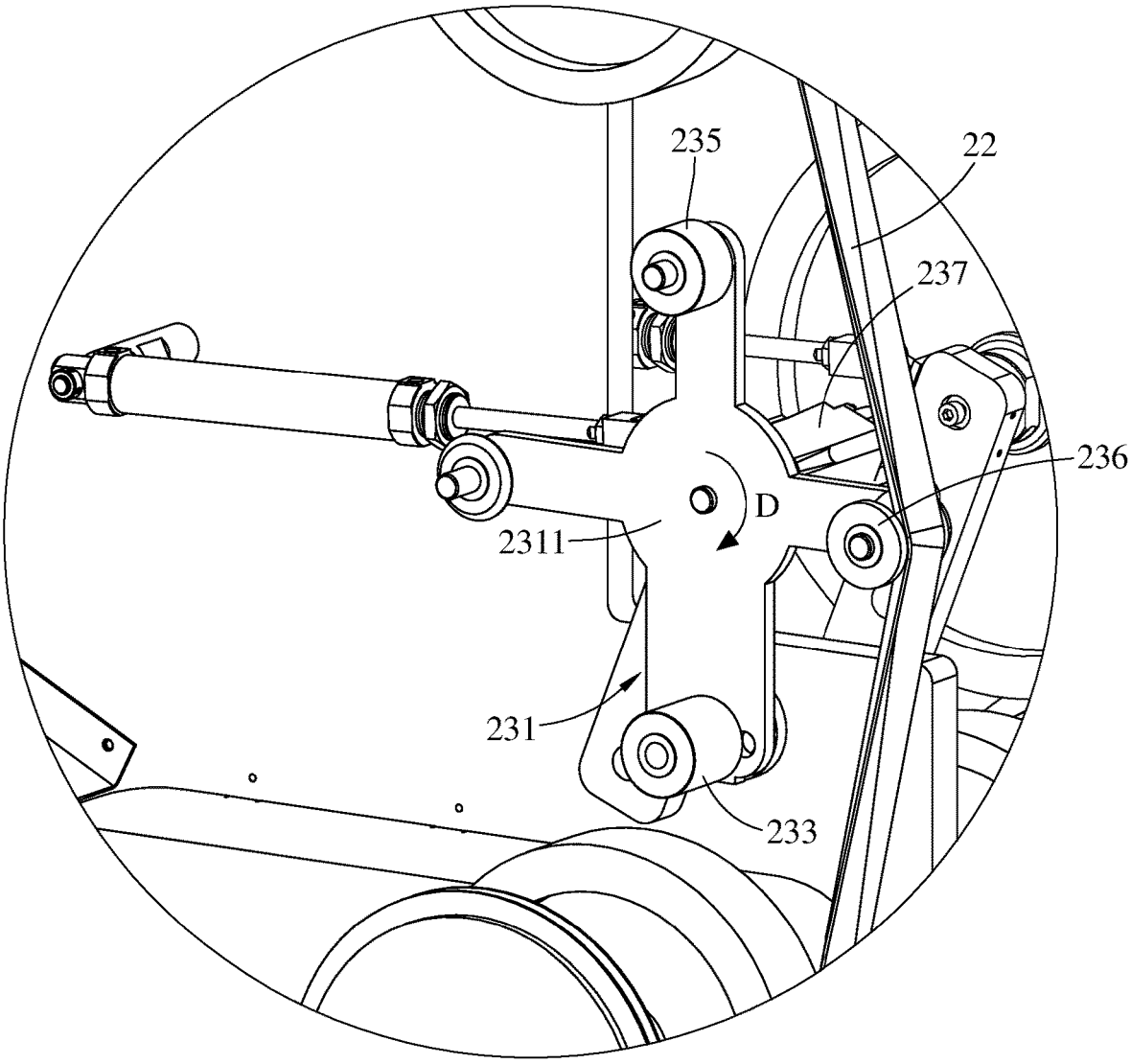
FIG. 5 is a partially enlarged view of the belt grinder of the first embodiment when another contact roller contacts the grinding belt.
Figure 6:
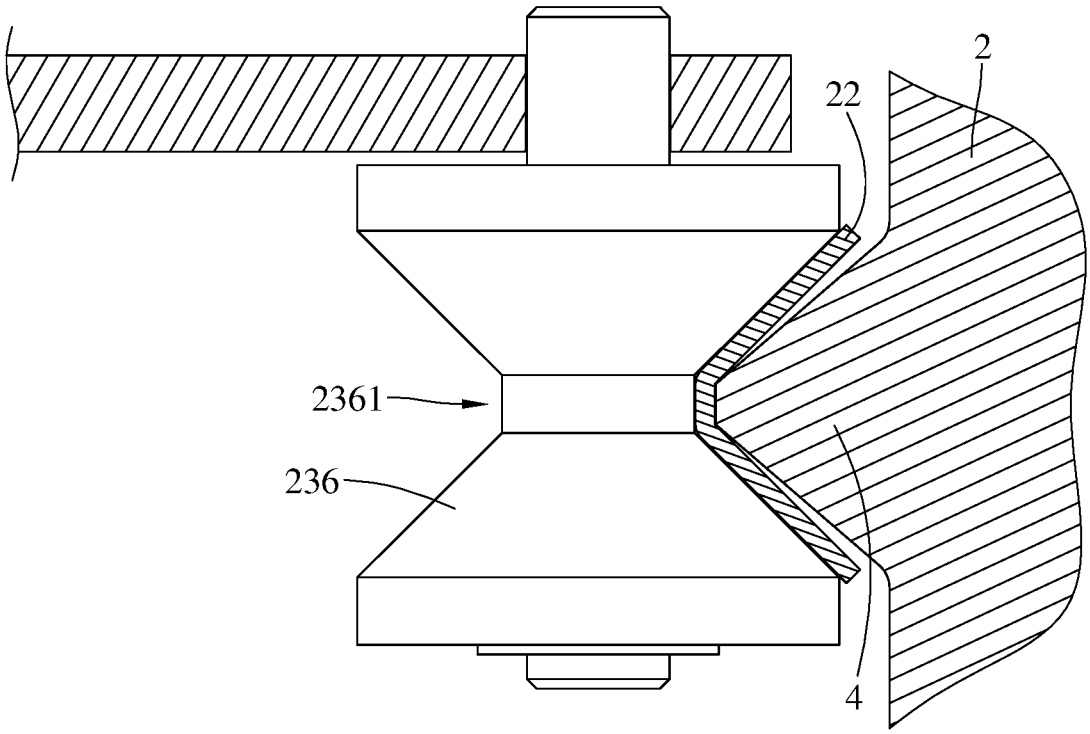
FIG. 6 is a partially enlarged cross-sectional view of one of the contact roller in FIG. 5 and a workpiece.

In this embodiment, the shape of the grinding belt 22 can be changed by rotating the rotatable component 231. Please refer to FIG. 5 and FIG. 6, FIG. 5 is a partially enlarged view of the belt grinder of the first embodiment when another contact roller contacts the grinding belt, and FIG. 6 is a partially enlarged cross-sectional view of one of the contact roller in FIG. 5 and a workpiece. The rotatable component 231 can be rotated in a direction D by being driven by the electric motor 237 so as to separate the contact roller 233 from the grinding belt 22 and then to move the contact roller 236 to contact the grinding belt 22. The contact roller 236 has a groove 2361. As the contact roller 236 contacts the grinding belt 22 and the grinding belt 22 contacts the workpiece 2, the grinding belt 22 is allowed to be folded inwardly to match the groove 2361 of the contact roller 236, such that the grinding belt 22 is able to grind a protrusion portion of the workpiece 2 (as shown in FIG. 6).

Figure 7:
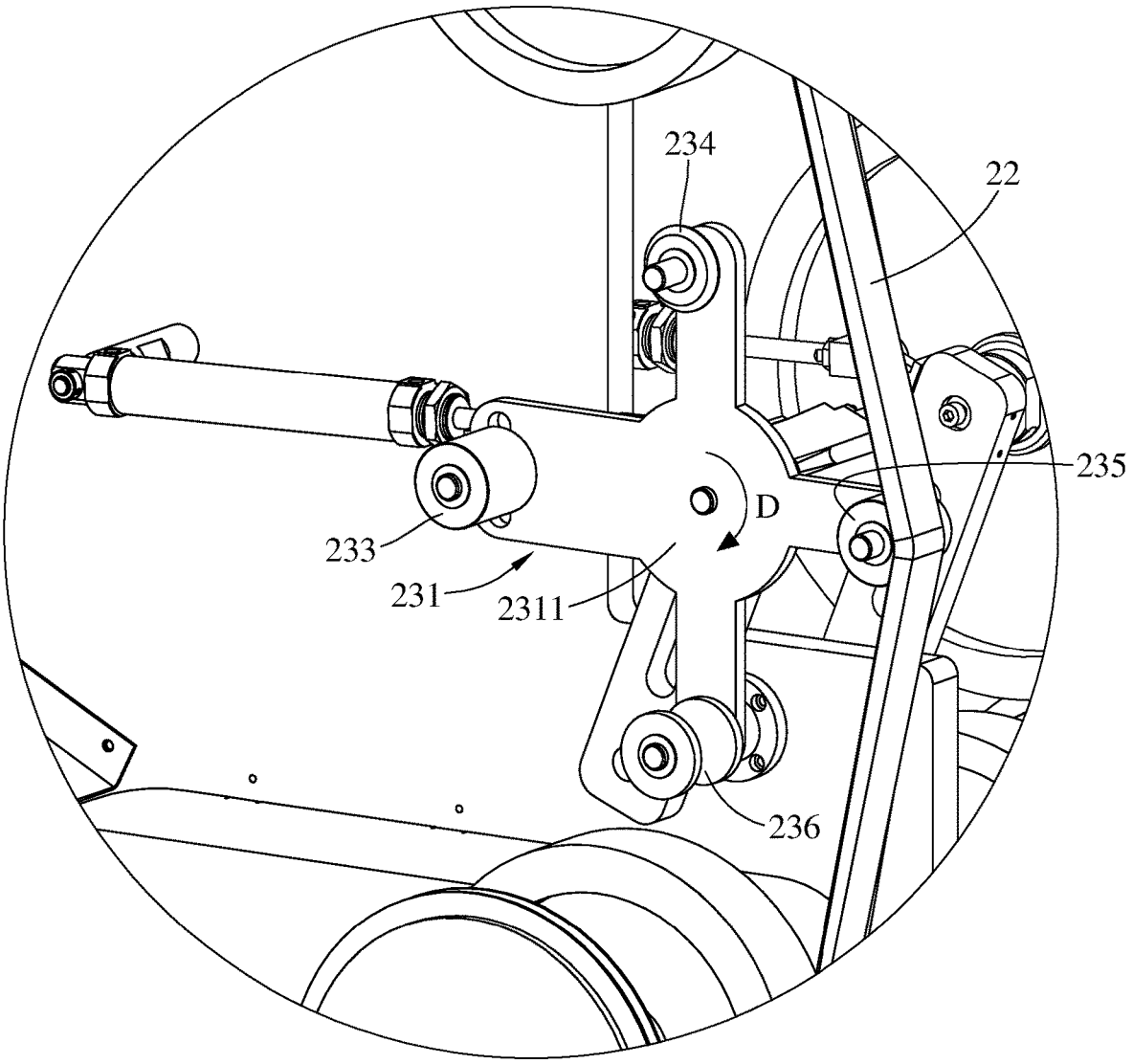
FIG. 7 is a partially enlarged view of the belt grinder of the first embodiment when still another contact roller contacts the grinding belt.

Then, please refer to FIG. 7. FIG. 7 is a partially enlarged view of the belt grinder of the first embodiment when still another contact roller contacts the grinding belt. The rotatable component 231 is able to be further rotated to separate the contact roller 236 from the grinding belt 22 and then to move the contact roller 235 to contact the grinding belt 22. The contact roller 235 has a smaller width than the other rollers (e.g., the contact roller 233). As the contact roller 235 contacts the grinding belt 22, the grinding belt 22 is forced to be deformed to match the shape of the contact roller 235, such that the grinding belt 22 is able to grind a rectangle trench of a workpiece.

Figure 8:
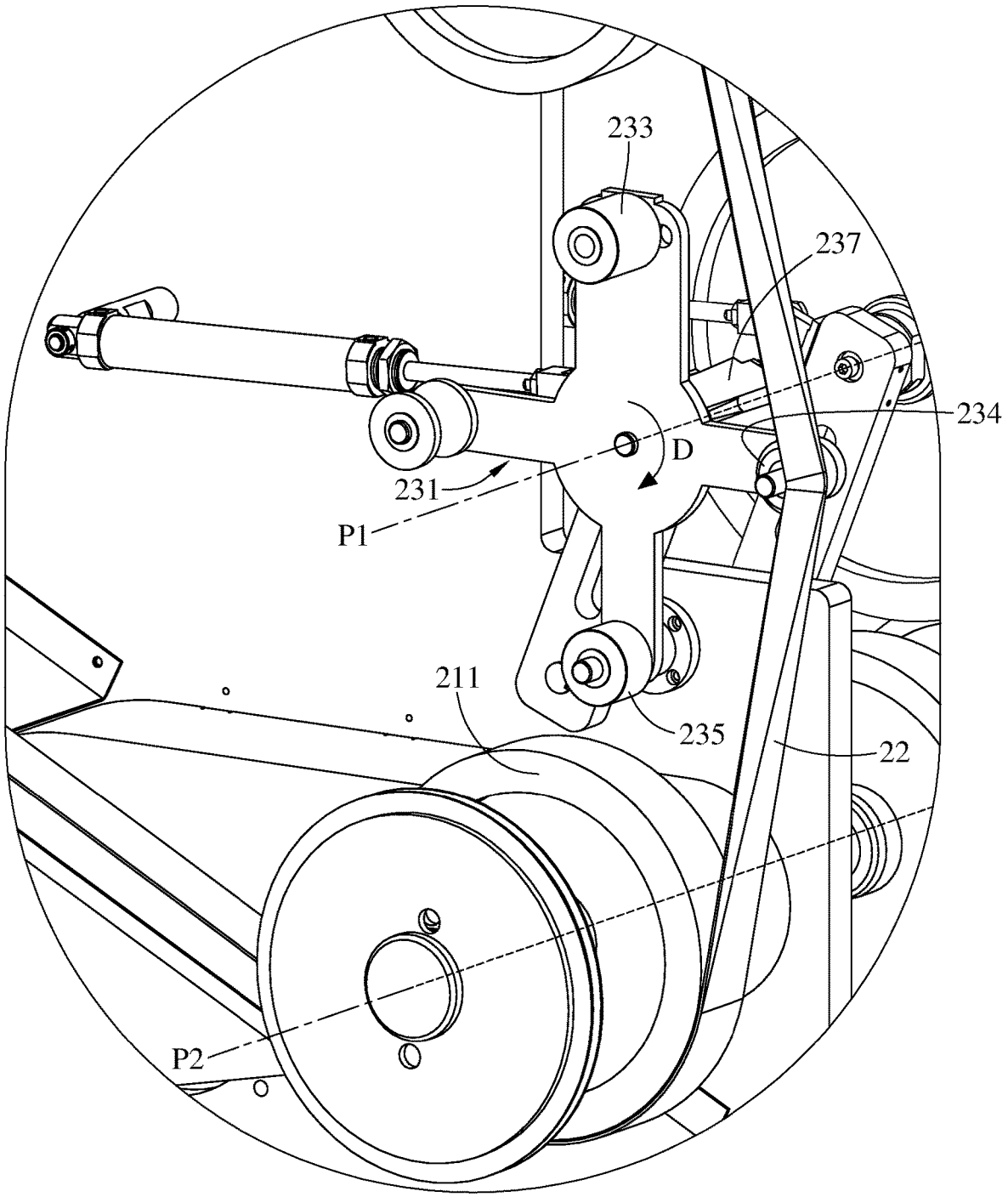
FIG. 8 is a partially enlarged view of the belt grinder of the first embodiment when still yet another contact roller contacts the grinding belt.
Figure 9:
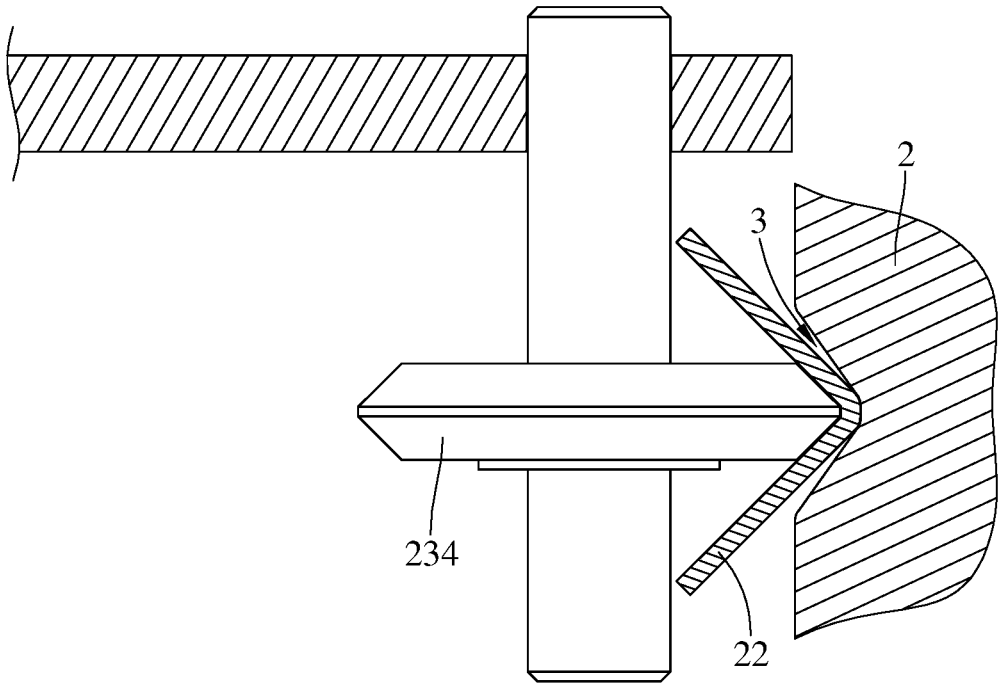
FIG. 9 is a partially enlarged cross-sectional view of one of the contact roller in FIG. 8 and a workpiece.

Then, please refer to FIG. 8 and FIG. 9, FIG. 8 is a partially enlarged view of the belt grinder of the first embodiment when still yet another contact roller contacts the grinding belt, and FIG. 9 is a partially enlarged cross-sectional view of one of the contact roller in FIG. 8 and a workpiece. The rotatable component 231 is further rotated to separate the contact roller 235 from the grinding belt 22 and then to move the contact roller 234 to contact the grinding belt 22. The contact roller 234 has a sharp edge (e.g, the pointy portion of the contact roller 234 in FIG. 9). As the contact roller 234 contacts the grinding belt 22, the grinding belt 22 is forced to be deformed to match the sharp edge of the contact roller 234, such that the grinding belt 22 is able to grind a v-shaped groove or slot of the workpiece 2.

As such, rotating the rotatable component 231 to alternatively let the contact rollers 233-236 to contact the grinding belt 22 is able to change the shape of the contact surface of the grinding belt 22 that grinds a workpiece.

In addition, it is noted that the order of the contact rollers 233-236 in the direction D is not restricted; it can be adjusted according to actual requirements.

Furthermore, since the rotation axis P1 of the rotatable component 231 is parallel to the rotation axis P2 of the driving roller 211, such that the rotatable component 231 is allowed to be rotated during the movement of the grinding belt 22.

Moreover, since the edges of the contact rollers 233-236 far away from the central portion 2311 of the rotatable component 231 are located at the same distance (e.g., L1, L2, L3 and L4 as shown in FIG. 3) from the rotation axis P1 of the central portion 2311, the tension of the grinding belt 22 is fixed whichever the contact roller 233, 234, 235 or 236 contacts the grinding belt 22.

Figure 10:
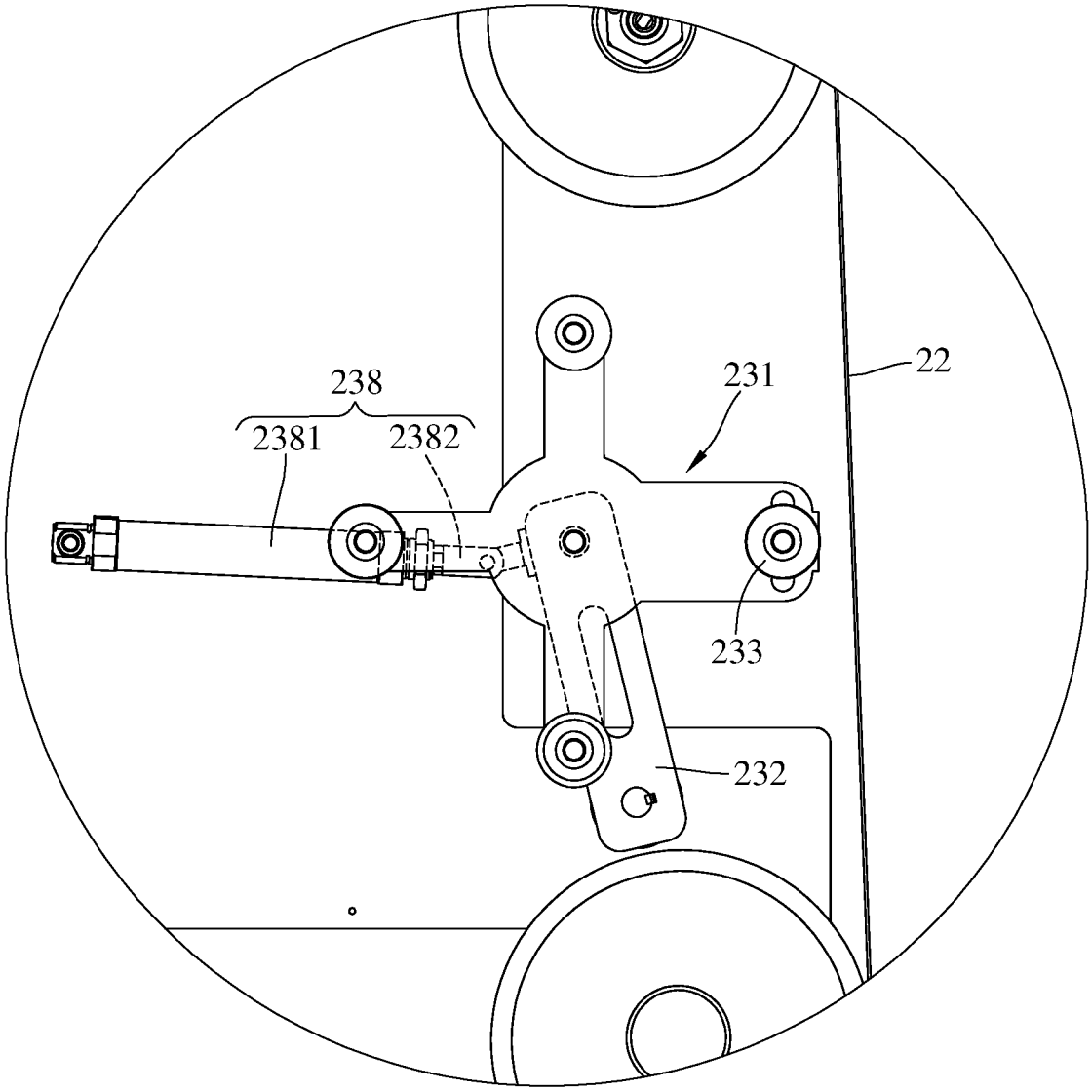
FIG. 10 is a partially enlarged side view of the belt grinder of the first embodiment when all of the contact rollers are separated from the grinding belt.

Then, please refer to FIG. 10, which is a partially enlarged side view of the belt grinder of the first embodiment when all of the contact rollers are separated from the grinding belt.

In this embodiment, the cylinder tank 2381 of the fluid driving device 238 is, for example, a pneumatic cylinder tank and is able to move the piston 2382 by air pressure. When the cylinder tank 2381 drives the piston 2382 to move away from the grinding belt 22, the piston 2382 moves the link 232 away from the grinding belt 22 so as to move the contact roller 233 away from the grinding belt 22 as well. By doing so, the contact roller 233 is changed from a contact state that is in contact with the grinding belt 22 as shown in FIG. 3 to a separated state that is separated from the grinding belt 22 as shown in FIG. 10. Accordingly, the grinding belt 22 is able to grind a workpiece without contacting all of the contact rollers 233-236.

On the contrary, the cylinder tank 2381 is also able to drive the piston 2382 to move toward the grinding belt 22 so as to force the contact roller 233 to back to contact the grinding belt 22.

Although, in this embodiment, the fluid driving device 238 is driven by air pressure, the disclosure is not limited thereto. In other embodiments, the fluid driving device may be driven by oil pressure. However, the fluid driving device 238 and the link 232 are optional. In another embodiment, the belt grinder may have no fluid driving device and link; in such a case, the rotatable component is directly disposed on the frame.

Figure 11:
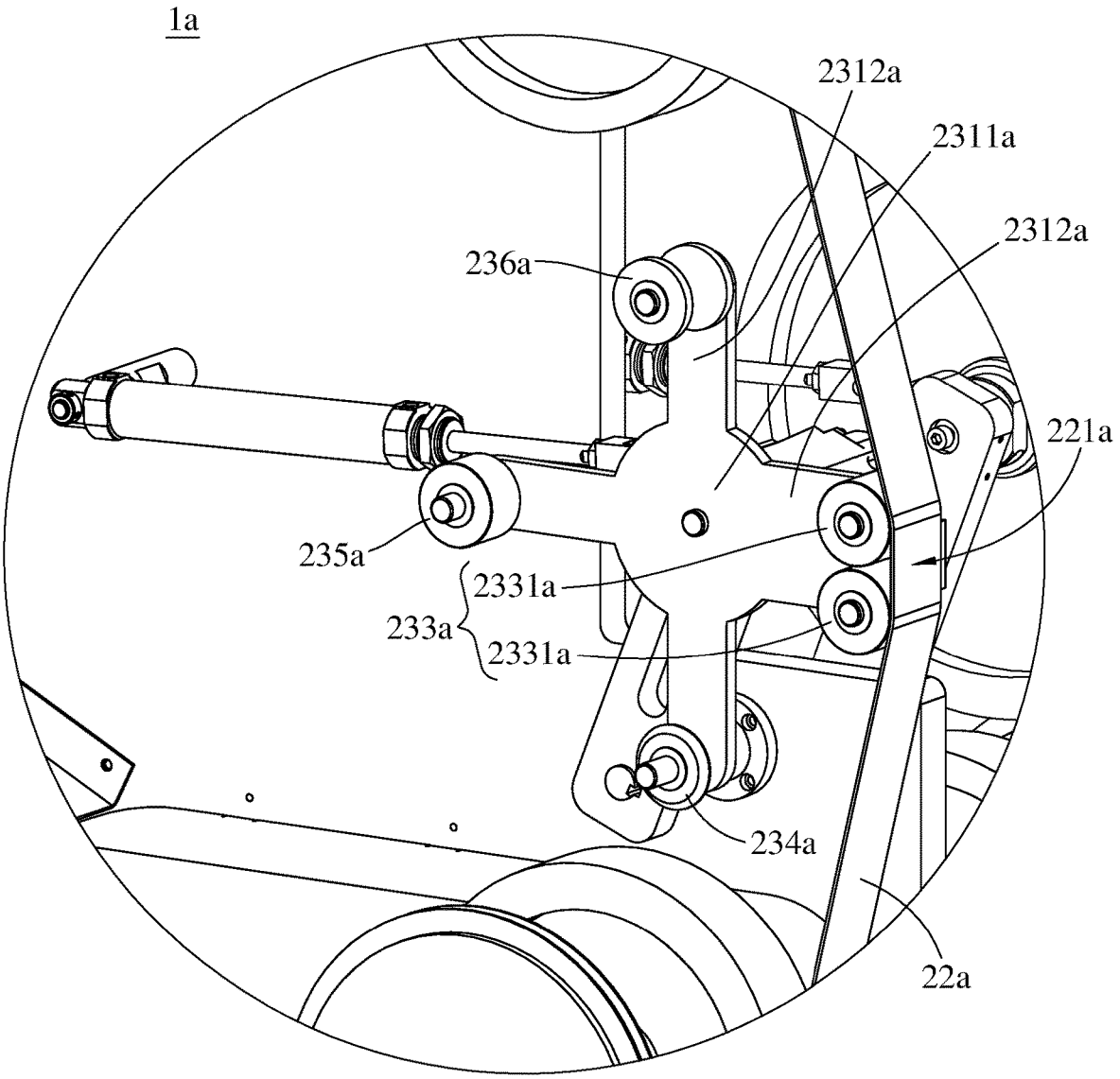
FIG. 11 is a partially enlarged view of a belt grinder according to a second embodiment of the present disclosure.

In addition, in this embodiment, each of the contact rollers 233-236 is a single wheel, but the disclosure is not limited thereto. Please refer to FIG. 11, which is a partially enlarged view of a belt grinder according to a second embodiment of the present disclosure.

This embodiment provides a belt grinder 1*a*. The belt grinder 1*a* is similar to the aforementioned belt grinder 1, thus only the difference therebetween will be described hereinafter. In this embodiment, the belt grinder 1*a* includes four contact rollers 233*a*-236*a* that are in different shapes. Among them, the contact roller 233*a* further includes two contact wheels 2331*a*. The contact wheels 2331*a* are rotatably disposed side by side at the end of one of the extension portions 2312*a*. As the contact wheels 2331*a* contacts the grinding belt 22, the contact wheels 2331*a* deform a portion of the grinding belt 22 and turn it into a flat surface 221*a*, such that the grinding belt 22*a* is allowed to grind a flat surface of a workpiece.

Figure 12:
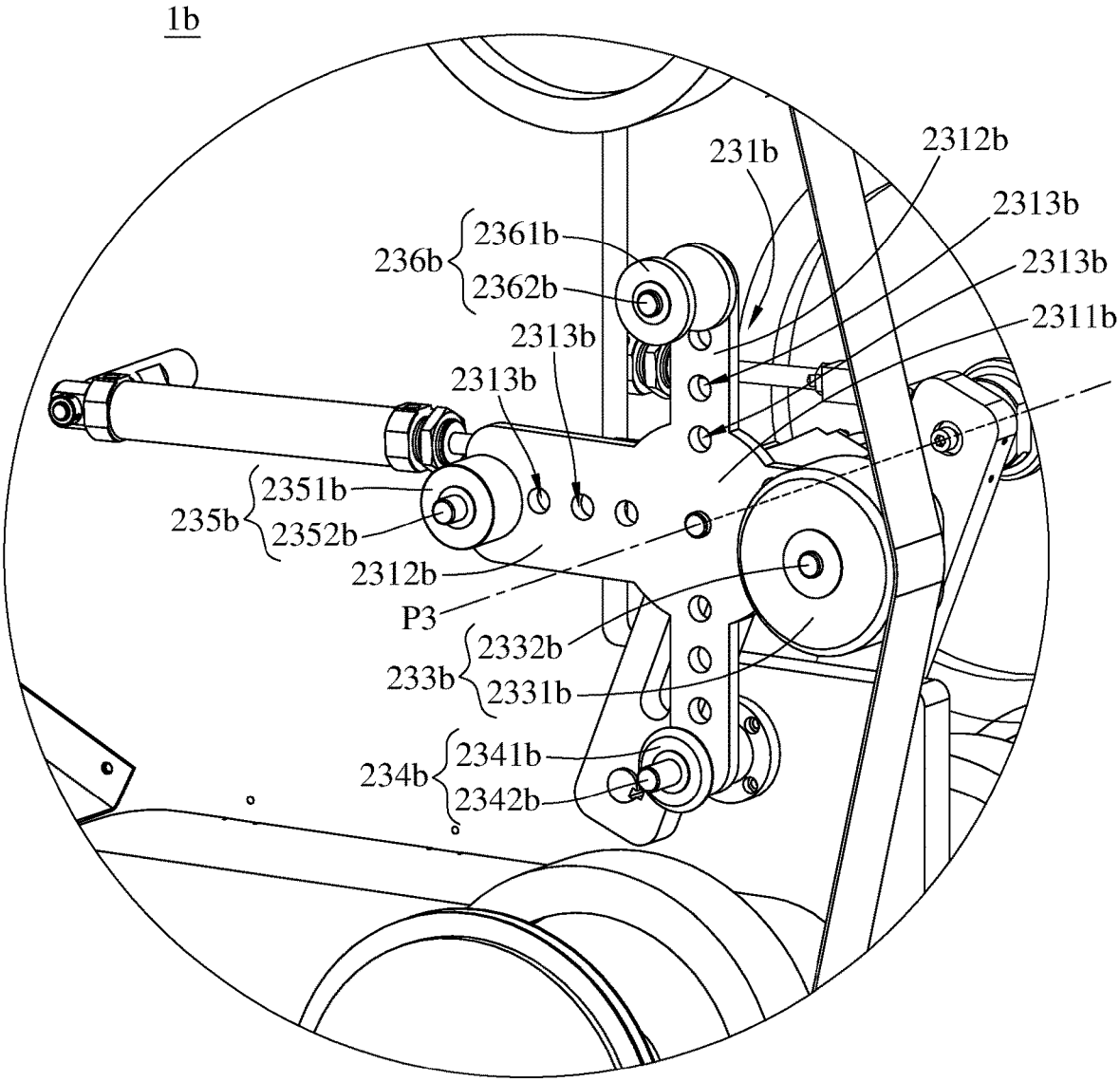
FIG. 12 is a partially enlarged view of a belt grinder according to a third embodiment of the present disclosure.
Figure 13:
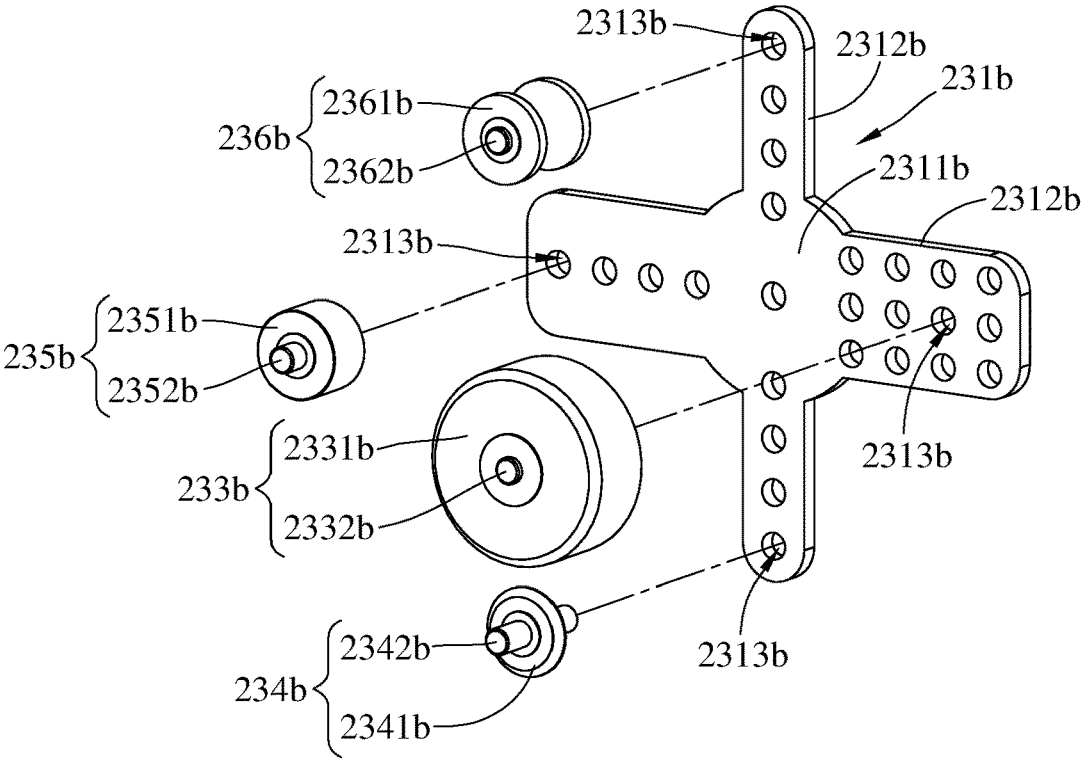
FIG. 13 is an exploded view of the rotatable component and the contact rollers in FIG. 12.

Furthermore, in the previous embodiments, the contact rollers have the same diameter, but the disclosure is not limited thereto. Please refer to FIG. 12 and FIG. 13, FIG. 12 is a partially enlarged view of a belt grinder according to a third embodiment of the present disclosure, and FIG. 13 is an exploded view of the rotatable component and the contact rollers in FIG. 12.

This embodiment provides a belt grinder 1*b*. The belt grinder 1*b* is similar to the aforementioned belt grinder 1, thus only the difference therebetween will be described hereinafter. In this embodiment, the belt grinder 1*b* includes a rotatable component 231*b* and contact rollers 233*b*-236*b*, the rotatable component 231*b* includes a central portion 2311*b* and four extension portions 2312*b*. The extension portions 2312*b* each have a plurality of mount holes 2313*b*. The contact rollers 233*b*-236*b* respectively include roller bodies 2331*b*, 2341*b*, 2351*b*, 2361*b* and respectively include pivots 2332*b*, 2342*b*, 2352*b*, 2362*b*. The pivots 2332*b*, 2342*b*, 2352*b*, 2362*b* are respectively partially inserted into the mount holes 2313*b* of the extension portions 2312*b*. The roller bodies 2331*b*, 2341*b*, 2351*b*, 2361*b* are respectively rotatably disposed on the pivots 2332*b*, 2342*b*, 2352*b*, 2362*b*. In addition, the contact roller 233*b* has a diameter larger than that of the other contact rollers 234*b*-236*b*.

On each extension portion 2312*b*, the mount holes 2313*b* are arranged in a direction parallel to a long side of the extension portion 2312*b*, thus the location of the contact roller 233*b* is able to be changed according to which mount hole 2313*b* it is mounted to. Therefore, although the contact roller 233*b* has a larger diameter, the edges of the contact rollers 233*b*-236*b* far away from the central portion 2311*b* of the rotatable component 231*b* are also able to be located at the same distance from a rotation axis P3 of the central portion 2311*b*.

Figure 14:
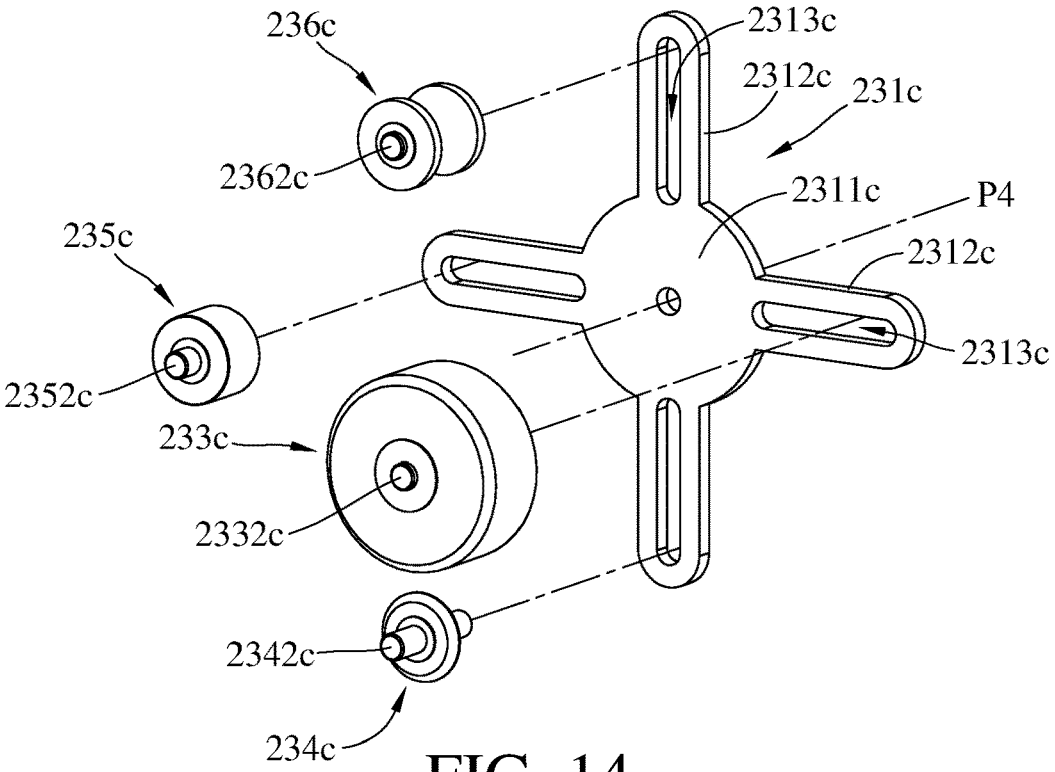
FIG. 14 is an exploded view of a rotatable component and contact rollers according to a fourth embodiment of the present disclosure.

Then, the mount holes on the extension portion may be replaced with a slot. For example, please refer to FIG. 14, which is an exploded view of a rotatable component and contact rollers according to a fourth embodiment of the present disclosure. It is noted that only the difference between the present embodiment and the previous embodiment will be described hereinafter.

This embodiment provides a rotatable component 231*c* and contact rollers 233*c*-236*c*, the rotatable component 231*c* includes a central portion 2311*c* and four extension portions 2312*c*. Each extension portions 2312*c* has an adjustment slot 2313*c*, which extends in a direction parallel to a long side of the extension portion 2312*c*. The contact rollers 233*c*-236*c* respectively have pivots 2332*c*, 2342*c*, 2352*c*, 2362*c* that are respectively disposed at the adjustment slots 2313*c* by screwing.

In such a configuration, the locations of the contact rollers 233*c*-236*c* are able to be changed. Therefore, although the contact roller 233*c* has a larger diameter, the edges of the contact rollers 233*c*-236*c* far away from the central portion 2311*c* of the rotatable component 231*c* are still able to be located at the same distance from a rotation axis P4 of the central portion 2311*c*.

According to the belt grinder in the embodiments above-mentioned, there are plural contact rollers that are in different shapes disposed on the rotatable component, thus rotating the rotatable component to alternatively let the contact rollers to contact the grinding belt is able to change the shape of the contact surface of the grinding belt that grinds a workpiece. Accordingly, the belt grinder is able to grind various shapes of surfaces, thereby having a wide application.

In addition, since the rotation axis of the rotatable component is parallel to the rotation axis of the driving roller, such that the rotatable component is allowed to be rotated during the movement of the grinding belt.

Moreover, since the edges of the contact rollers far away from the central portion of the rotatable component are located at the same distance from the rotation axis of the central portion, the tension of the grinding belt is fixed while different contact roller contacts the grinding belt.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. A belt grinder, comprising:

a frame; and a first grinding assembly, comprising:

a transmission roller set, comprising a driving roller and at least one driven roller, and both the driving roller and the at least one driven roller being rotatably disposed on the frame;

a grinding belt, being installed over the driving roller and the at least one driven roller; and an adjusting assembly, comprising:

a rotatable component, being rotatably and movably disposed on the frame, a rotation axis of the rotatable component being parallel to a rotation axis of the driving roller wherein a movement direction of the rotatable component is perpendicular to the rotation axis of the driving roller, and the rotatable component is movable toward or away from the grinding belt in the movement direction perpendicular to the rotation axis of the driving roller; and a plurality of contact rollers, being rotatably disposed on the rotatable component, and at least two of the plurality of contact rollers being different in shape;

wherein the rotatable component is rotatable with respect to the frame so as to force at least one of the plurality of contact rollers to contact or to be separated from the grinding belt, one of the plurality of contact rollers has a groove, and another of the plurality of contact rollers has a width smaller than a width of the grinding belt.

2. The belt grinder according to claim 1, wherein the rotatable component is a manually driven component or an electrically driven component.

3. The belt grinder according to claim 1, wherein the adjusting assembly further comprises an electric motor, which is configured to drive the rotatable component to rotate.

4. The belt grinder according to claim 3, wherein the electric motor is a servomotor.

5. The belt grinder according to claim 1, wherein the rotatable component comprises a central portion and a plurality of extension portions, which are respectively extending in different directions from the central portion, and the plurality of contact rollers are respectively rotatably disposed at ends of the extension portions located away from the central portion.

6. The belt grinder according to claim 5, wherein maximum distances from edges of the plurality of contact rollers to the rotation axis of the rotatable component are the same.

7. The belt grinder according to claim 5, wherein the amount of the plurality of contact rollers is four, the amount of the plurality of extension portions is four, a reference line passing through the ends of two of the extension portions located away from the central portion is perpendicular to another reference line passing through the ends of the other two of the extension portions located away from the central portion.

8. The belt grinder according to claim 5, wherein the amount of the plurality of contact rollers is four, the amount of the plurality of extension portions is four, a reference line passing through the ends of two of the extension portions located away from the central portion is perpendicular to another reference line passing through the ends of the other two of the extension portions located away from the central portion, one of the four contact rollers comprises two contact wheels, the two contact wheels are rotatably disposed side by side at the end of one of the extension portions located away from the central portion, and the other three of the contact rollers are respectively rotatably disposed at the ends of the other three of the extension portions located away from the central portion, and as the two contact wheels contact the grinding belt, the contact wheels deform a portion of the grinding belt and turn it into a flat surface.

9. The belt grinder according to claim 5, wherein the plurality of extension portions each have a plurality of mount holes, and the plurality of contact rollers each comprise a pivot, which is partially inserted into one of the plurality of mount holes and a roller body, which is rotatably disposed on the pivot.

10. The belt grinder according to claim 5, wherein the plurality of extension portions each have an adjustment slot, and the plurality of contact rollers each comprise a pivot, which is disposed at one of the adjustment slots and a roller body, which is rotatably disposed on the pivot.

11. The belt grinder according to claim 1, wherein the adjusting assembly further comprises a fluid driving device disposed on the frame, the fluid driving device is configured to drive the rotatable component to move toward or away from the grinding belt so as to force one of the plurality of contact rollers to contact the grinding belt or to force the plurality of contact rollers to be separated from the grinding belt.

12. The belt grinder according to claim 11, wherein the fluid driving device is driven by air pressure or oil pressure.

13. The belt grinder according to claim 1, further comprising a platform, wherein the frame is disposed on the platform, and the platform allows the frame to pivot about an axis perpendicular to the rotation axis of the driving roller.

14. The belt grinder according to claim 1, further comprising a shaft and a grinding roller, wherein the grinding roller and the driving roller are rotatably disposed on the frame via the shaft.

15. The belt grinder according to claim 1, further comprising a second grinding assembly, wherein the first grinding assembly and the second grinding assembly are respectively located at two opposite sides of the frame, the second grinding assembly comprises a transmission roller set, a grinding belt and a contact roller, the transmission roller set of the second grinding assembly comprises a driving roller and at least one driven roller, both the driving roller and the at least one driven roller of the second grinding assembly are rotatably disposed on the frame, the grinding belt of the second grinding assembly is installed over the driving roller and the at least one driven roller of the second grinding assembly, the contact roller of the second grinding assembly is rotatably disposed on the frame, and the contact roller of the second grinding assembly and the plurality of contact rollers of the first grinding assembly respectively correspond to the grinding belts of the second grinding assembly and the first grinding assembly.

* * * * *